US007963132B2

(12) United States Patent
Andres et al.

(10) Patent No.: US 7,963,132 B2
(45) Date of Patent: Jun. 21, 2011

(54) LOCKING DEVICE WITH PASSAGE

(75) Inventors: Guillermo Andres, Pleasanton, CA (US); Lambert Kuo, Tainan (TW)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 12/768,494

(22) Filed: Apr. 27, 2010

(65) Prior Publication Data

US 2010/0263414 A1 Oct. 21, 2010

Related U.S. Application Data

(63) Continuation of application No. 12/361,147, filed on Jan. 28, 2009, now Pat. No. 7,730,751, which is a continuation of application No. 11/283,322, filed on Nov. 18, 2005, now Pat. No. 7,500,371.

(51) Int. Cl.
*E05B 69/00* (2006.01)

(52) U.S. Cl. ..... 70/58; 70/491; 70/416

(58) Field of Classification Search ..... 70/58, 404, 70/491, 416, 418–421
See application file for complete search history.

(56) References Cited

U.S. PATENT DOCUMENTS

| | | | |
|---|---|---|---|
| 87,045 | A | 2/1869 | Holmes |
| 95,509 | A | 10/1869 | Petre |
| 285,074 | A | 9/1883 | Rhoades et al. |
| 505,299 | A | 9/1893 | Schneider |
| 541,630 | A | 6/1895 | Ridgway |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 989,484 | A | 4/1911 | Campbell |
| 1,004,333 | A | 9/1911 | Alsterberg |
| 1,050,276 | A | 1/1913 | Johnson |
| 1,101,450 | A | 6/1914 | Kerry |
| 1,213,992 | A | 1/1917 | Wright |

(Continued)

FOREIGN PATENT DOCUMENTS

| | | |
|---|---|---|
| CA | 454901 | 3/1949 |

(Continued)

OTHER PUBLICATIONS

Kablit Security System Catalog, pp. 7, 93, 1988. Computer and Office Equipment Security Catalog, 1990, Secure-It, Inc., 18 Maple Court, East Longmeadow, MA 01028.

(Continued)

*Primary Examiner* — Suzanne D Barrett
(74) *Attorney, Agent, or Firm* — Kilpatrick Townsend & Stockton LLP

(57) ABSTRACT

A lock device for use with a key is disclosed. The lock device includes a locking spindle including a plurality of locking spindle bores and a passage extending axially along an axial length of the locking spindle, and a driver structure including a plurality of driver structure bores. An interface between the driver structure and the locking spindle forms a shear line. The lock device also includes a plurality of combination pins in the plurality of locking spindle bores, and a plurality of driver pins in the driver structure bores in the driver structure, the plurality of driver pins being respectively associated with the plurality of combination pins.

12 Claims, 6 Drawing Sheets

U.S. PATENT DOCUMENTS 1,387,442 A 8/1921 Lee
1,432,546 A 10/1922 Gillom
1,452,471 A 4/1923 Kline
1,468,955 A 9/1923 Bresee
1,468,958 A 9/1923 Champion
1,470,937 A 10/1923 Schou
1,534,936 A 4/1925 Fishchbach
1,672,333 A 6/1928 Miller
1,786,511 A 12/1930 Warren
1,851,986 A 4/1932 Rubsamen
1,891,214 A 12/1932 Falk
1,978,935 A 1/1933 Douglas
2,001,354 A 5/1935 Smith
2,032,821 A 3/1936 Waits
2,102,583 A 12/1937 Alberg
2,109,109 A 2/1938 Finch
2,130,216 A 9/1938 Zaninovich
2,172,208 A 9/1939 Kutrzon
2,190,661 A 2/1940 Hauer
2,383,397 A 8/1945 Lofquist
2,405,400 A 8/1946 Butterfiled
2,435,876 A 2/1948 De Swart
2,469,874 A 5/1949 Fetsko, Jr.
2,480,662 A 8/1949 McKinzie
2,530,560 A 11/1950 Young
2,577,956 A 12/1951 Elsberg
2,578,547 A 12/1951 Hilger
2,594,012 A 4/1952 Griffin
2,660,084 A 11/1953 Newman
2,677,261 A 5/1954 Jacobi
2,729,418 A 1/1956 Maynard
2,800,090 A 7/1957 Reid
2,963,310 A 12/1960 Abolins
3,091,011 A 5/1963 Campbell
3,101,695 A 8/1963 Honeyman, Jr.
3,130,571 A 4/1964 Neumann
3,136,017 A 6/1964 Preziosi
3,171,182 A 3/1965 Danehy
3,174,384 A 3/1965 Vanni
3,200,694 A 8/1965 Rapata
3,211,408 A 10/1965 Schaefer
3,213,745 A 10/1965 Dwyer
3,220,077 A 11/1965 Newcomer, Jr. et al.
3,267,707 A 8/1966 Adams
3,276,835 A 10/1966 Hall
3,380,268 A 4/1968 Perrill
3,469,874 A 9/1969 Mercurio
3,486,158 A 12/1969 Soltysik et al.
3,509,748 A 5/1970 George
3,521,845 A 7/1970 Sweda et al.
3,524,335 A 8/1970 George
3,541,819 A 11/1970 Keer
3,590,608 A 7/1971 Smyth et al.
3,596,285 A 7/1971 Gottwald
3,625,031 A 12/1971 Alley, III
3,634,963 A 1/1972 Hermann
3,664,163 A 5/1972 Foote
3,722,239 A 3/1973 Mestre
3,727,934 A 4/1973 Averbook et al.
3,737,135 A 6/1973 Bertolini
3,738,136 A 6/1973 Falk
3,754,420 A 8/1973 Oellerich
3,765,197 A 10/1973 Foote
3,766,760 A 10/1973 Mohrhauser et al.
3,771,338 A 11/1973 Raskin
3,772,645 A 11/1973 Odenz et al.
3,782,146 A 1/1974 Franke
3,783,660 A 1/1974 Gill
3,785,183 A 1/1974 Sander
3,798,934 A 3/1974 Wright et al.
3,813,906 A 6/1974 Keer
3,817,066 A 6/1974 Pearson
3,826,510 A 7/1974 Halter
D232,416 S 8/1974 Gazda et al.
3,836,704 A 9/1974 Coules
3,859,826 A 1/1975 Singer et al.
3,866,873 A 2/1975 Bohli
3,875,645 A 4/1975 Tucker et al.
3,878,700 A 4/1975 Lopez
3,898,641 A 8/1975 Banner
3,903,720 A 9/1975 Scherbing
3,905,570 A 9/1975 Nieuwveld
3,910,079 A 10/1975 Gassaway
3,910,081 A 10/1975 Pender
3,939,752 A 2/1976 Koscik
3,986,780 A 10/1976 Nivet
3,990,276 A 11/1976 Shontz
3,999,410 A 12/1976 Hall
4,003,228 A 1/1977 Lievens et al.
4,004,440 A 1/1977 Dreyer
4,006,615 A 2/1977 Szova
4,007,613 A 2/1977 Gassaway
4,018,339 A 4/1977 Pritz
4,028,913 A 6/1977 Falk
4,028,916 A 6/1977 Pender
4,041,739 A 8/1977 Mercurio
4,047,748 A 9/1977 Whaley et al.
4,055,973 A 11/1977 Best
4,057,984 A 11/1977 Avaiusini
4,065,083 A 12/1977 Gassaway
4,066,195 A 1/1978 Dickler
4,066,231 A 1/1978 Bahner
4,069,696 A 1/1978 Steinbach
4,078,405 A 3/1978 Steinbach
4,104,951 A 8/1978 Leitner
4,111,020 A 9/1978 Scherbing
4,112,820 A * 9/1978 Conger et al. ..... 70/491
4,114,409 A 9/1978 Scire
4,118,902 A 10/1978 Saxton
4,123,922 A 11/1978 Kuenstler
4,131,001 A 12/1978 Gotto
4,212,175 A 7/1980 Zakow
4,223,542 A 9/1980 Basseches
4,252,007 A 2/1981 Kerley
4,263,833 A 4/1981 Loudin
4,300,371 A 11/1981 Herwick et al.
4,311,883 A 1/1982 Kidney
4,328,691 A 5/1982 Scherbing
4,337,462 A 6/1982 Lemelson
4,383,425 A 5/1983 Orabona
4,391,110 A 7/1983 Nielsen
4,394,101 A 7/1983 Richer
4,418,550 A 12/1983 Hamilton
4,419,034 A 12/1983 DiMartino
4,442,571 A 4/1984 Davis et al.
4,448,049 A 5/1984 Murray
4,462,233 A 7/1984 Horetzke
4,466,259 A 8/1984 Osgood
4,471,980 A 9/1984 Hickman
4,478,545 A 10/1984 Mizusawa
4,501,460 A 2/1985 Sisler
4,502,305 A 3/1985 Bakker
4,507,945 A 4/1985 Hwang
4,520,641 A 6/1985 Bako
4,527,405 A 7/1985 Renick et al.
4,546,629 A 10/1985 Hwang
4,570,465 A 2/1986 Bennett
4,579,492 A 4/1986 Kazino
4,584,856 A 4/1986 Petersdorff et al.
4,586,843 A 5/1986 Heng et al.
4,593,273 A 6/1986 Narcisse
4,598,272 A 7/1986 Cox
4,603,829 A 8/1986 Koike et al.
4,610,152 A 9/1986 Duringer
4,610,587 A 9/1986 Wollar
4,616,490 A 10/1986 Robbins
4,620,182 A 10/1986 Keifer
4,640,106 A 2/1987 Derman
4,651,544 A 3/1987 Hungerford
4,653,297 A * 3/1987 Moorhouse ..... 70/491
4,654,640 A 3/1987 Carll et al.
4,655,057 A 4/1987 Derman
4,656,848 A 4/1987 Rose
4,667,491 A 5/1987 Lokken et al.
4,676,080 A 6/1987 Schwarz
4,680,949 A 7/1987 Stewart
4,685,312 A 8/1987 Lakoski et al.

4,691,891 A 9/1987 Dionne
4,692,968 A 9/1987 Girard
4,704,881 A 11/1987 Sloop, Sr.
4,722,208 A 2/1988 Ye
4,733,840 A 3/1988 D'Amore
4,735,067 A 4/1988 Tawil
4,738,428 A 4/1988 Themistos et al.
4,741,185 A 5/1988 Weinert et al.
4,768,361 A 9/1988 Derman
4,770,583 A 9/1988 Lindberg
4,779,434 A 10/1988 Derman
4,785,291 A 11/1988 Hawthorne
4,801,232 A 1/1989 Hempel
4,802,354 A 2/1989 Johnson
4,803,860 A 2/1989 Moore
4,804,943 A 2/1989 Soleimani
4,805,426 A 2/1989 Dimmick et al.
4,813,252 A 3/1989 Ray
4,818,032 A 4/1989 Thomas
4,826,193 A 5/1989 Davis
4,831,852 A 5/1989 Hughes
4,831,860 A 5/1989 Sheiman et al.
4,834,600 A 5/1989 Lemke
4,842,912 A 6/1989 Hutter, III
4,843,848 A 7/1989 Igelmund
4,856,304 A 8/1989 Derman
4,856,305 A 8/1989 Adams
4,858,455 A 8/1989 Kuo
4,860,561 A 8/1989 Hwang
4,862,716 A 9/1989 Derman
4,869,082 A 9/1989 Appelbaum
4,870,840 A 10/1989 Klein
4,878,045 A 10/1989 Tanaka et al.
4,893,488 A 1/1990 Klein
4,896,140 A 1/1990 Biever
4,901,057 A 2/1990 Suneborn
4,907,111 A 3/1990 Derman
4,907,716 A 3/1990 Wankel et al.
4,908,605 A 3/1990 Takatsuka
4,912,953 A * 4/1990 Wobig ..... 70/383
4,918,952 A 4/1990 Lakoski et al.
4,924,683 A 5/1990 Derman
4,924,693 A 5/1990 College
4,938,040 A 7/1990 Humphreys, Jr.
4,959,635 A 9/1990 Wilson
4,959,979 A 10/1990 Filipow et al.
4,964,285 A 10/1990 Lakoski
4,966,511 A 10/1990 Lee
4,969,342 A 11/1990 Marchiori
4,978,265 A 12/1990 DeWan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,020,349 A 6/1991 Lee
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,066,942 A 11/1991 Matsuo
5,067,151 A 11/1991 Inagaki
5,076,079 A 12/1991 Monoson
5,082,232 A 1/1992 Wilson
5,082,233 A 1/1992 Ayers et al.
5,099,663 A 3/1992 Dearstine
5,117,661 A 6/1992 Carl et al.
5,119,649 A 6/1992 Spence
5,133,203 A 7/1992 Huang
5,135,197 A 8/1992 Kelley et al.
5,138,785 A 8/1992 Paterson
5,146,769 A 9/1992 Smith
5,154,456 A 10/1992 Moore
5,169,326 A 12/1992 Werner
5,171,049 A 12/1992 Grandy, Sr. et al.
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,235,831 A 8/1993 Lauria et al.
5,279,136 A 1/1994 Perry
5,317,304 A 5/1994 Choi
5,327,752 A * 7/1994 Myers et al. ..... 70/58
D350,473 S 9/1994 Simon
5,349,834 A 9/1994 Davidge
5,349,835 A 9/1994 Liao
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,386,005 A 1/1995 Mascia et al.
5,390,514 A 2/1995 Harmon
5,390,977 A 2/1995 Miller
5,394,713 A 3/1995 Harmon
5,397,176 A 3/1995 Allen et al.
5,398,530 A 3/1995 Derman
5,400,622 A 3/1995 Harmon
5,402,662 A 4/1995 Osada
5,406,809 A 4/1995 Igelmund
5,412,959 A 5/1995 Bentley
5,421,667 A 6/1995 Leyden et al.
5,447,049 A 9/1995 Shieh
5,466,022 A 11/1995 Derman
5,473,917 A 12/1995 Say
5,489,173 A 2/1996 Hofle
5,493,878 A 2/1996 Murray et al.
5,502,989 A 4/1996 Murray et al.
5,520,031 A 5/1996 Davidge
D370,473 S 6/1996 Derman
5,544,512 A 8/1996 Shieh
5,548,981 A 8/1996 Kirk
5,570,080 A 10/1996 Inoue et al.
5,579,657 A 12/1996 Makous
5,593,878 A 1/1997 Knopf et al.
5,603,416 A 2/1997 Richardson et al.
5,608,605 A 3/1997 Siow et al.
5,610,587 A 3/1997 Fujiuchi et al.
5,611,223 A 3/1997 Spitzer
5,622,064 A 4/1997 Gluskoter et al.
5,622,067 A 4/1997 Waitz
5,636,539 A 6/1997 Tsai
5,653,136 A 8/1997 Huang
5,661,991 A 9/1997 Hsu
5,687,592 A 11/1997 Penniman et al.
5,692,400 A 12/1997 Bliven et al.
5,709,110 A 1/1998 Greenfield et al.
5,722,268 A 3/1998 Choi
5,761,934 A 6/1998 Kuo
5,787,738 A 8/1998 Brandt et al.
5,787,739 A 8/1998 Derman
5,791,171 A 8/1998 Kelley
5,794,463 A 8/1998 McDaid
5,799,520 A 9/1998 Laabs et al.
5,836,183 A 11/1998 Derman
5,870,281 A 2/1999 Kim
5,875,657 A 3/1999 Kelley
5,884,508 A 3/1999 Dwight
5,889,463 A 3/1999 Judd et al.
5,913,907 A 6/1999 Lee
5,924,313 A 7/1999 Kuo
5,934,120 A 8/1999 Kuo
5,960,651 A 10/1999 Tanisawa
5,963,131 A 10/1999 D'Angelo et al.
5,983,679 A 11/1999 Reyes
5,987,937 A 11/1999 Lee
6,000,251 A 12/1999 Murray et al.
6,000,252 A 12/1999 Murray et al.
6,006,557 A 12/1999 Carl et al.
6,038,891 A 3/2000 Zeren et al.
6,058,744 A 5/2000 Ling
6,081,974 A 7/2000 McDaid

| | | | | |
|---|---|---|---|---|
| 6,087,939 | A | 7/2000 | Leyden et al. | |
| 6,112,561 | A | 9/2000 | Carl | |
| 6,112,562 | A | 9/2000 | Murray, Jr. et al. | |
| 6,125,669 | A | 10/2000 | McDaid et al. | |
| 6,133,830 | A | 10/2000 | D'Angelo et al. | |
| 6,150,940 | A | 11/2000 | Chapman et al. | |
| 6,155,088 | A | 12/2000 | Murray, Jr. et al. | |
| 6,170,364 | B1 | 1/2001 | Johnson | |
| 6,173,591 | B1 | 1/2001 | Derman | |
| 6,199,413 | B1 | 3/2001 | McDaid et al. | |
| 6,205,824 | B1 | 3/2001 | Miao | |
| 6,212,918 | B1 | 4/2001 | Kravtin | |
| 6,212,922 | B1 | 4/2001 | Miao | |
| 6,227,017 | B1 | 5/2001 | Igelmund | |
| 6,244,080 | B1 | 6/2001 | Sakurai | |
| 6,244,082 | B1 | 6/2001 | Avganim | |
| 6,255,957 | B1 | 7/2001 | Sonderegger et al. | |
| 6,257,029 | B1 | 7/2001 | Liao | |
| 6,262,664 | B1 | 7/2001 | Maloney | |
| 6,265,974 | B1 | 7/2001 | D'Angelo et al. | |
| 6,300,874 | B1 | 10/2001 | Rand | |
| 6,301,940 | B1 | 10/2001 | Derman et al. | |
| 6,317,936 | B1 | 11/2001 | McDaid et al. | |
| 6,360,405 | B1 | 3/2002 | McDaid et al. | |
| 6,389,853 | B1 | 5/2002 | Pate et al. | |
| 6,389,854 | B1 | 5/2002 | Huang | |
| 6,401,502 | B1 | 6/2002 | Yang | |
| 6,401,504 | B1 | 6/2002 | Derman et al. | |
| 6,420,958 | B1 | 7/2002 | Miller et al. | |
| 6,427,499 | B1 | 8/2002 | Derman | |
| 6,442,984 | B1 | 9/2002 | Katoh et al. | |
| 6,449,992 | B1 | 9/2002 | Yu | |
| 6,463,770 | B1 | 10/2002 | Lee | |
| 6,513,350 | B1 | 2/2003 | Hurd et al. | |
| 6,523,373 | B1 | 2/2003 | Su | |
| 6,523,378 | B2 | 2/2003 | Kuo | |
| 6,553,794 | B1 | 4/2003 | Murray, Jr. et al. | |
| 6,584,819 | B1 | 7/2003 | Hung | |
| 6,588,241 | B1 | 7/2003 | Murray, Jr. et al. | |
| 6,591,642 | B1 | 7/2003 | Kuo | |
| 6,598,433 | B1 | 7/2003 | Malvasio | |
| 6,619,080 | B1 | 9/2003 | Yu | |
| 6,619,081 | B1 | 9/2003 | Yu | |
| 6,621,415 | B1 | 9/2003 | Willis | |
| 6,672,117 | B2 | 1/2004 | Yu | |
| 6,705,133 | B1 | 3/2004 | Auganim | |
| 6,718,808 | B2 | 4/2004 | Yu | |
| 6,735,990 | B1 | 5/2004 | Murray, Jr. et al. | |
| 6,745,330 | B1 | 6/2004 | Maillot | |
| 6,758,069 | B2 | 7/2004 | Derman | |
| 6,763,688 | B1 | 7/2004 | Syu | |
| 6,763,690 | B2 | 7/2004 | Galant | |
| 6,799,445 | B1 | 10/2004 | Tsai | |
| 6,811,145 | B2 | 11/2004 | Gibbs et al. | |
| 6,845,643 | B2 | 1/2005 | Tsai | |
| 6,848,926 | B2 | 2/2005 | Ling et al. | |
| 6,886,376 | B2 | 5/2005 | Kuo | |
| 6,911,897 | B2 | 6/2005 | Miller et al. | |
| 6,918,272 | B1 | 7/2005 | Sanders | |
| 6,933,847 | B2 | 8/2005 | Feibelman | |
| 6,971,254 | B2 | 12/2005 | Bellow, Jr. et al. | |
| 6,973,809 | B2 | 12/2005 | Chang | |
| 6,991,479 | B2 | 1/2006 | Miao | |
| 7,007,522 | B1 | 3/2006 | Lee | |
| 7,028,513 | B2 | 4/2006 | Avganim | |
| 7,076,977 | B2 | 7/2006 | Lee | |
| 7,079,032 | B2 | 7/2006 | Merrem et al. | |
| 7,111,479 | B2 | 9/2006 | Murray et al. | |
| 7,121,125 | B2 | 10/2006 | Murray et al. | |
| 7,140,210 | B2 | 11/2006 | Cheng | |
| 7,143,614 | B1 | 12/2006 | Murray et al. | |
| 7,150,168 | B1 * | 12/2006 | Kuo | 70/491 |
| 7,160,137 | B1 | 1/2007 | Yeh | |
| 7,191,623 | B2 | 3/2007 | Francke | |
| 7,234,330 | B2 | 6/2007 | Tseng | |
| 7,370,499 | B1 | 5/2008 | Lee | |
| 7,409,842 | B2 | 8/2008 | Kuo | |
| 7,415,852 | B1 | 8/2008 | Merrem | |
| 7,428,834 | B1 | 9/2008 | Lee | |
| 7,441,426 | B2 | 10/2008 | Avganim | |
| 7,441,431 | B2 * | 10/2008 | Weber et al. | 70/491 |
| 7,462,045 | B1 | 12/2008 | Lee | |
| 7,479,879 | B2 | 1/2009 | Merrem et al. | |
| 7,500,371 | B2 * | 3/2009 | Andres et al. | 70/491 |
| 7,540,334 | B2 | 6/2009 | Gass et al. | |
| 7,614,264 | B2 | 11/2009 | McGettrick | |
| 7,614,266 | B2 | 11/2009 | White et al. | |
| 7,635,272 | B2 | 12/2009 | Poppe | |
| 7,642,671 | B2 | 1/2010 | Mahaffey | |
| 7,647,796 | B2 | 1/2010 | Francke | |
| 7,685,854 | B2 * | 3/2010 | Xu et al. | 70/491 |
| 7,730,751 | B2 * | 6/2010 | Andres et al. | 70/58 |
| 7,805,969 | B2 | 10/2010 | Poppe et al. | |
| 2002/0104337 | A1 | 8/2002 | Kuo | |
| 2002/0134119 | A1 | 9/2002 | Derman | |
| 2003/0101778 | A1 | 6/2003 | Carl et al. | |
| 2003/0224637 | A1 | 12/2003 | Ling | |
| 2004/0040350 | A1 | 3/2004 | Derman | |
| 2004/0074264 | A1 | 4/2004 | Kung et al. | |
| 2004/0079122 | A1 | 4/2004 | Tsai | |
| 2004/0206138 | A1 | 10/2004 | Murray et al. | |
| 2005/0039502 | A1 | 2/2005 | Avganim | |
| 2005/0097930 | A1 | 5/2005 | Moore et al. | |
| 2005/0150262 | A1 | 7/2005 | Murray et al. | |
| 2005/0150263 | A1 | 7/2005 | Murray et al. | |
| 2005/0178173 | A1 | 8/2005 | Kuo | |
| 2005/0202698 | A1 | 9/2005 | Miao | |
| 2005/0204786 | A1 | 9/2005 | Meyer et al. | |
| 2005/0236521 | A1 | 10/2005 | Krause et al. | |
| 2005/0280500 | A1 | 12/2005 | Miller et al. | |
| 2006/0081021 | A1 | 4/2006 | Merrem et al. | |
| 2006/0107073 | A1 | 5/2006 | Lane et al. | |
| 2006/0112740 | A1 | 6/2006 | Merrem et al. | |
| 2006/0117816 | A1 | 6/2006 | Lee | |
| 2007/0033975 | A1 * | 2/2007 | Liu | 70/491 |
| 2008/0110217 | A1 | 5/2008 | Andrews et al. | |
| 2009/0049876 | A1 | 2/2009 | White | |
| 2009/0090149 | A1 | 4/2009 | Fox | |
| 2010/0024497 | A1 * | 2/2010 | Wu | 70/419 |
| 2010/0139337 | A1 | 6/2010 | Hung | |
| 2010/0192642 | A1 * | 8/2010 | Hung et al. | 70/58 |
| 2010/0263414 | A1 | 10/2010 | Andres et al. | |

FOREIGN PATENT DOCUMENTS

| | | | |
|---|---|---|---|
| CA | 791364 | | 8/1968 |
| CA | 987121 | | 4/1976 |
| DE | 329934 | | 12/1920 |
| DE | 335741 | | 4/1921 |
| DE | 361068 | | 4/1923 |
| DE | 456219 | | 2/1928 |
| DE | 577757 | | 8/1932 |
| DE | 3202700 | A1 | 4/1983 |
| DE | 3407723 | A1 | 9/1985 |
| DE | 3824393 | | 7/1989 |
| DE | 10203647 | | 8/2003 |
| DE | 202004015891 | C1 | 12/2004 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| FR | 2741375 | | 5/1997 |
| GB | 447091 | | 5/1936 |
| GB | 1256295 | | 12/1971 |
| GB | 1376011 | | 12/1974 |
| GB | 2109109 | A | 5/1983 |
| GB | 2201725 | | 9/1988 |
| GB | 2234856 | A | 2/1991 |
| HU | P0000398 | | 6/2000 |
| HU | 224329 | | 6/2003 |
| IT | 451949 | | 10/1949 |
| JP | 49-91096 | | 11/1947 |
| JP | 37-7592 | | 6/1959 |
| JP | 52-36813 | | 3/1977 |
| JP | 57-25092 | | 2/1982 |
| JP | 57-179618 | | 11/1982 |
| JP | 087462 | | 1/1996 |

| | | | |
|---|---|---|---|
| JP | 2000-305845 | | 11/2000 |
| JP | 2000-140948 | | 5/2005 |
| NO | 14095 | | 5/1905 |
| WO | WO 95/10680 | | 4/1985 |
| WO | WO 86/00396 | | 1/1986 |
| WO | WO 93/15295 | | 8/1993 |
| WO | WO 96/07002 | A1 | 3/1996 |
| WO | WO 96/15347 | A1 | 5/1996 |
| WO | WO 2008/051919 | A1 | 5/2008 |
| WO | WO 2008/051930 | A1 | 5/2008 |
| WO | WO 2008/147818 | A1 | 12/2008 |
| WO | WO 2009/026225 | A1 | 2/2009 |
| WO | WO 2010/080402 | A1 | 7/2010 |

OTHER PUBLICATIONS

Kensington Product Brochure for Kensington Apple Laser Writer and Macintosh Portable Security Systems, Computer and Office Equipment Security Catalog, 1990, Secure-It, Inc., 18 Maple Court, East Longmeadow, MA 01028.
Apple Security Bracket sold in AS kit.
Retaining Device Incorporated in Apple Computers.
Kensington MicroSaver Computer Lock Box and Literature, 3 pages.
Kensington Product News Release; "Kensington Wins Case Protecting Cable Lock Status", 2003, 1 page.
*Acco Brands, Inc.* v. *Micro Security Devices, Inc.* Federal Circuit Court Order Granting Defendant's Motion for Summary Judgment, Jul. 23, 2002, 13 pages.
Maltoni, D. et al.; "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.
Targus DEFCON 1 Ultra Notebook Computer Security System, User's Guide, copyright 2001.
Targus DEFCON 1 Ultra Notebook Computer Security System; http://www.targus.com/us/product_details.asp?sku=PA400U.
U.S. Appl. No. 12/242,059, filed Sep. 30, 2008.
U.S. Appl. No. 12/446,560, filed Apr. 21, 2009.
U.S. Appl. No. 12/446,556, filed Apr. 21, 2009.
U.S. Appl. No. 12/870,599, filed Aug. 27, 2010.
Vantec Notebook Lock, model # NBL-S100, 2004, 1 page.
DS-SNAP-IT-MXS, Datamation, 2007, 1 page.

* cited by examiner

LOCKING DEVICE WITH PASSAGE

CROSS-REFERENCES TO RELATED APPLICATIONS

This application is a continuation of U.S. patent application Ser. No. 12/361,147, filed Jan. 28, 2009, which is a continuation of U.S. patent application Ser. No. 11/283,322 filed on Nov. 18, 2005, the disclosures of which are both herein incorporated by reference in their entirety for all purposes.

BACKGROUND OF THE INVENTION

Recent news reports indicate that the plastic barrel of a certain type of pen can be used to open a certain type of tubular lock that is present on bicycle locks. According to the news reports, the plastic barrel can be inserted into the keyway of the tubular lock, and after some effort, the lock can be opened. The insertion of the plastic barrel into the keyway of a tubular lock can mold the plastic barrel to the shape of a key, and the molded barrel could be potentially used to turn the lock.

Improvements to deter this type of lock picking would be desirable.

BRIEF SUMMARY OF THE INVENTION

Embodiment of the invention are directed to lock devices, locking apparatuses, locking systems, and methods for using the same.

One embodiment of the invention is directed to a lock device for use with a key with an extended portion, the lock device comprising: a locking spindle including a plurality of locking spindle bores and a passage extending axially along an axial length of the locking spindle; a driver structure including a plurality of driver structure bores, wherein an interface between the driver structure and the locking spindle forms a shear line; a plurality of combination pins in the plurality of locking spindle bores; and a plurality of driver pins in the driver structure bores in the driver structure, the plurality of driver pins being respectively associated with the plurality of combination pins, wherein the passage is configured to receive the extended portion of the key, and wherein the extended portion extends to the shear line when the key is used to turn the locking spindle.

Another embodiment of the invention is directed to a locking apparatus comprising: a lock device comprising a locking spindle including a plurality of locking spindle bores and a passage extending axially along an axial length of the locking spindle, a driver structure including a plurality of driver structure bores, wherein an interface between the driver structure and the locking spindle forms a shear line, a plurality of combination pins in the plurality of locking spindle bores, and a plurality of driver pins in the driver structure bores in the driver structure, the plurality of driver pins being respectively associated with the plurality of combination pins; and a key including a coded portion and an extended portion, wherein the extended portion is configured to fit in the passage and extends to the shear line.

Another embodiment of the invention is directed to a method for using a lock device, the method comprising: inserting a key into a keyway of a lock device, wherein the key includes an extended portion that passes through a passage in a locking spindle in the lock device and to a shear line between the locking spindle and a driver structure; and turning the key.

Other embodiments of the invention are described in further detail below.

DETAILED DESCRIPTION

One embodiment of the invention is directed to a lock device for use with a key with an extended portion. The lock device may be a cylinder lock. In one embodiment, the lock device comprises a locking spindle including a plurality of locking spindle bores and a passage extending axially along an axial length of the locking spindle, and a driver structure including a plurality of driver structure bores. (As used herein, "along an axial length" includes a passage that extends at least partially along a portion of the locking spindle.) An interface between the driver structure and the locking spindle forms a shear line. The lock device also includes a plurality of combination pins in the plurality of locking spindle bores, and a plurality of driver pins in the driver structure bores in the driver structure, the plurality of driver pins being respectively associated with the plurality of combination pins. The extended portion of the key can extend exactly or approximately to the shear line to provide a temporary solid interface portion for the locking spindle. As a result, the driver pins in the driver structure stay on one side of the shear line when an authorized key is used to lock and/or unlock the lock device.

The lock devices according to embodiments of the invention can be used to secure or prevent the theft of any suitable types of articles. Such articles include bicycles, furniture, etc. However, the articles that can be secured by the lock devices according to embodiments of the invention are preferably portable electronic devices. Examples of portable electronic devices include portable computers (e.g., laptop computers), wireless phones, portable music players, DVRs (digital video recorders), flat panel displays and television sets, etc.

Figure 1:
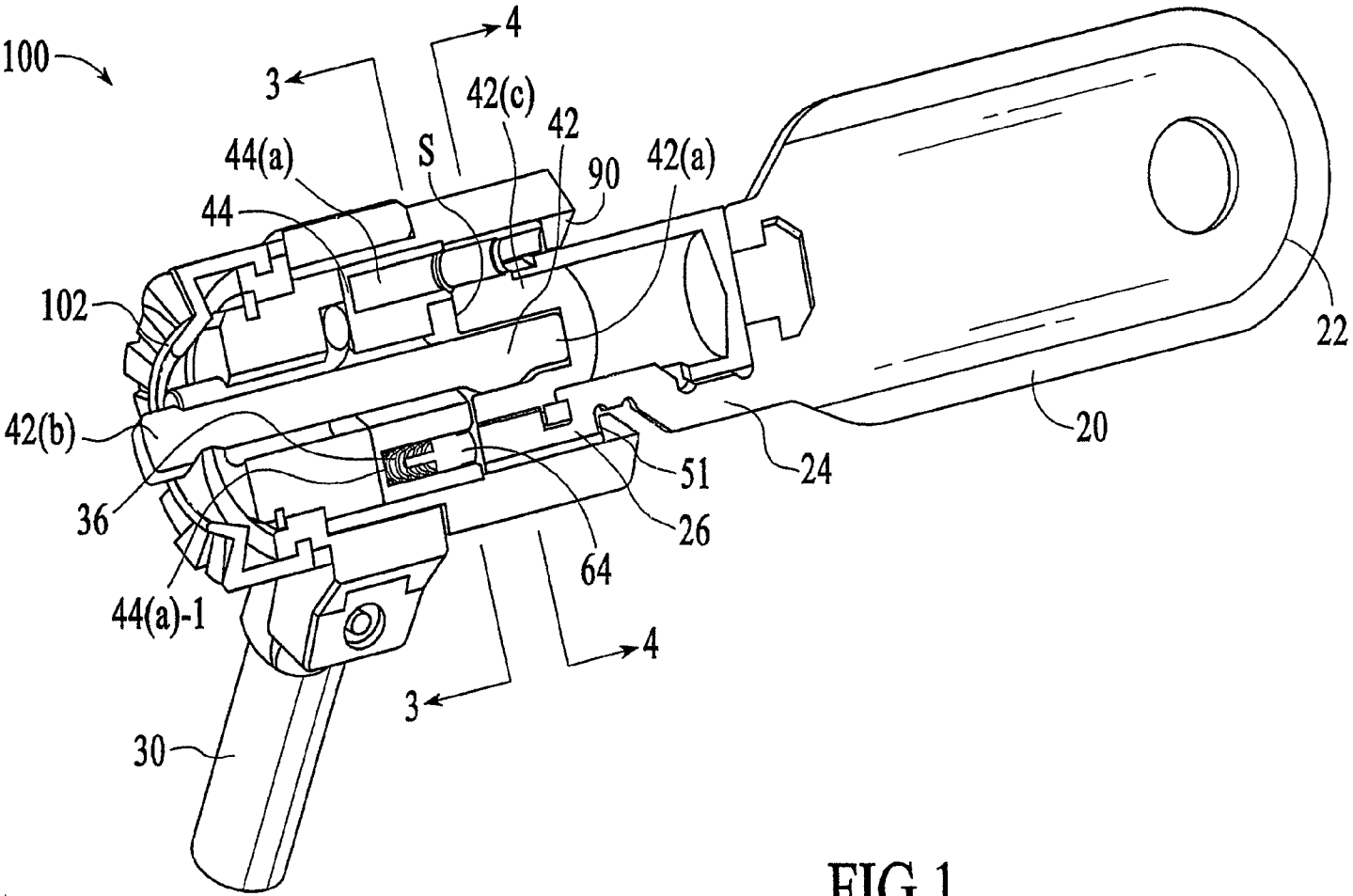
FIG. 1 discloses a cross-sectional perspective view of a lock assembly according to an embodiment of the invention.

FIG. 1 shows a locking apparatus 100 according to an embodiment of the invention. The locking apparatus 100 includes a key 20 and a lock device 102. These components, alone or in conjunction with other components, can form a locking apparatus according to an embodiment of the invention.

The key 20 includes a handle 22, an extended portion 26 and a coded portion 24 between the extended portion 26 and the handle 22. These features are described in further detail below.

The lock device 102 includes a housing 90. In this example, the housing 90 may include a tubular or cylindrical structure. It may be made of a material such as stainless steel or any other hard material.

A cable 30 or the like may be attached to the housing 90. The cable 30 may be a stainless steel cable or the like. In some embodiments, a distal end of the cable 30 may include a loop. To secure an article to an immovable object (e.g., a desk), the cable 30 may be looped around a portion of an immovable object (e.g., a leg of a desk) and the head of the lock device may pass through the loop. The lock device 102 may be attached to the article using a locking member that is present in the lock device 102. In some cases, the article may include a slot through which the locking member is inserted. The locking member may then be configured to a locked position to secure the head of the lock device to the article, and consequently to the immovable object.

Various components may be inside of the housing 90 of the lock device 102. For example, as illustrated in FIG. 1, a locking spindle 42 is cooperatively engaged with a driver structure 44 inside of the housing 90. In embodiments of the invention, the locking spindle 42 may rotate with respect to the driver structure 44. A shear line S may be defined by an interface between the driver structure 44 and the locking spindle 42.

The locking spindle 42 has a proximate end 42(*a*) near the front of the lock device 102 and a distal end 42(*b*) near the rear of the lock device 102. As shown in FIG. 1, the distal end 42(*b*) of the locking spindle 42 passes through the center of the driver structure 44. The locking spindle 42 can turn or rotate (clockwise or counterclockwise) relative to the driver structure 44, when the combination pins and driver pins do not lie across the shear line S.

The proximate end 42(*a*) includes a cylindrical portion including a number of locking spindle bores 42(*c*). The locking spindle bores 42(*c*) extend axially through the cylindrical portion of the locking spindle 42 at the proximate end 42(*a*) of the locking spindle 42. A plurality of combination pins (not shown) may be respectively disposed within the locking spindle bores 42(*c*). The combination pins can have different lengths and may correspond to the notched portions of the coded portion 24 of the key 20. If desired, the driver pins may also have different lengths.

A passage 51 is in the locking spindle 42 and is configured to receive the extended portion 26 of the key 20. The passage 51 may also have any suitable cross-sectional shape (e.g., a circular shape). In embodiments of the invention, the passage 51 may be in the form of an open channel at a side of the locking spindle 42, or may be in the form of a closed channel in the locking spindle 42. In either case, the passage 51 is configured to receive an extended portion 26 of the key 20 when the key 20 is being used to change the lock device 102 from a locked configuration to an unlocked configuration, or vice-versa. A distal end of the extended portion 26 of the key 20 extends to the shear line S to fill the passage 51 and to temporarily provide a solid surface for the locking spindle 42 at the interface S. As will be explained in further detail below, this prevents driver pins in the driver spindle bores 44(*a*) in the driver structure 44 from lying over the shear line S.

As shown in FIG. 1, the driver structure 44 may include a plurality of driver spindle bores 44(*a*). The driver spindle bores 44(*a*) also extend axially through the driver structure 44. They may also be disposed in a circle around a central axis of the driver spindle 44. Driver pins (not shown) may be respectively disposed within the driver spindle bores 44(*a*). A plurality of springs 36 may also be respectively disposed within the driver structure bores 44(*a*). These springs 36 push the driver pins (not shown) toward the shear line S.

During normal operation, one or more of the forwardly biased driver pins cross the shear line S when the locking device 102 is in a locked configuration. This prevents the locking spindle 42 from rotating relative to the driver structure 44 and prevents a locking member attached to the locking spindle 42 from moving. When the locking device 102 is in an unlocked configuration, the driver pins may be pushed rearward by corresponding combination pins in the locking spindle bores 42. The coded portion 24 of the key has cutouts of different depths so that the combination pins are pushed rearwardly different distances. When the combination pins are pushed rearward, the driver pins are on one side of the shear line S, while the combination pins are on the other side of the shear line S. Since the combination pins and the driver pins are separated from each other at the shear line S, this allows the locking spindle 42 to turn relative to the driver structure 44.

The driver and combination pins may be formed of any suitable structure and may be made of any suitable material. For example, the pins may be in the form of a peg, post, straight cylinder, a cylinder with a head, etc.

The operation of the passage 51 and the extended portion 26 of the key 20 will now be described. When the lock device 102 is in an unlocked position, the driver pin 64 may be biased toward the front of the lock device 102, may pass into a corresponding locking spindle bore 42(*c*), and may lie over the shear line S. In order to turn the locking spindle 42 and a locking member (not shown) attached to the locking spindle 42 to put the lock device 102 into an unlocked configuration, the key 20 is inserted in the keyway of the lock device 102 and the extended portion 26 of the key extends into the passage 51. The extended portion fills the passage 51 and keeps the driver pin 64 on one side of the shear line S as the locking spindle 42 rotates relative to the driver structure 44.

If one tries to insert an unauthorized tubular structure such as the barrel of a ballpoint pen into the keyway of the lock device 102, the molded barrel of the ballpoint pen cannot pass through the entire axial length of the passage 51. Even if the unauthorized user is successful in partially turning the locking spindle 42, the locking spindle 42 will still not be able to fully rotate. As the unauthorized user tries to turn the unauthorized tubular structure in the keyway of the lock device 102, the driver structure bore 44(*a*)-1 becomes aligned with the passage 51. Since there is no corresponding combination pin in the passage 51 and since the unauthorized tubular structure (not shown) does not fill the passage 51 to the shear line S, the driver pin 64 will be forward biased across the shear line S by the spring 36 when the passage 51 is aligned with the driver structure bore 44(*a*)-1. Consequently, the unauthorized user will not be able to completely turn the locking spindle 42 relative to the driver structure 44 and therefore cannot unlock the lock device 102.

In the preferred embodiment described above, the passage is configured to receive one of the driver pins if an unauthorized tubular structure is used to turn the locking spindle. However, a structure (e.g., a ball, cube, pyramid, etc.) other than a driver pin may be present in a driver spindle bore in other embodiments and may also prevent the use of an unauthorized tubular structure as a locking and/or unlocking device. In these alternative embodiments, the structure may lie in a driver spindle bore along with a biasing element such as a spring. The biasing element may bias the structure towards the shear line. If the key with the extended portion is inserted into the keyway of the lock device and if the extended portion extends to the shear line, the biased structure will remain on the driver spindle side of the shear line. If an unauthorized tubular structure is inserted into the keyway of the lock device, the unauthorized tubular structure cannot extend to the shear line. When the unauthorized tubular structure is used to turn the locking spindle, the driver spindle bore will become aligned with the passage. The biased structure will then pass into the passage and will lie over the shear line, thereby preventing further rotation of the locking spindle and preventing the authorized tubular structure from locking and/or unlocking the lock device.

Figure 2:
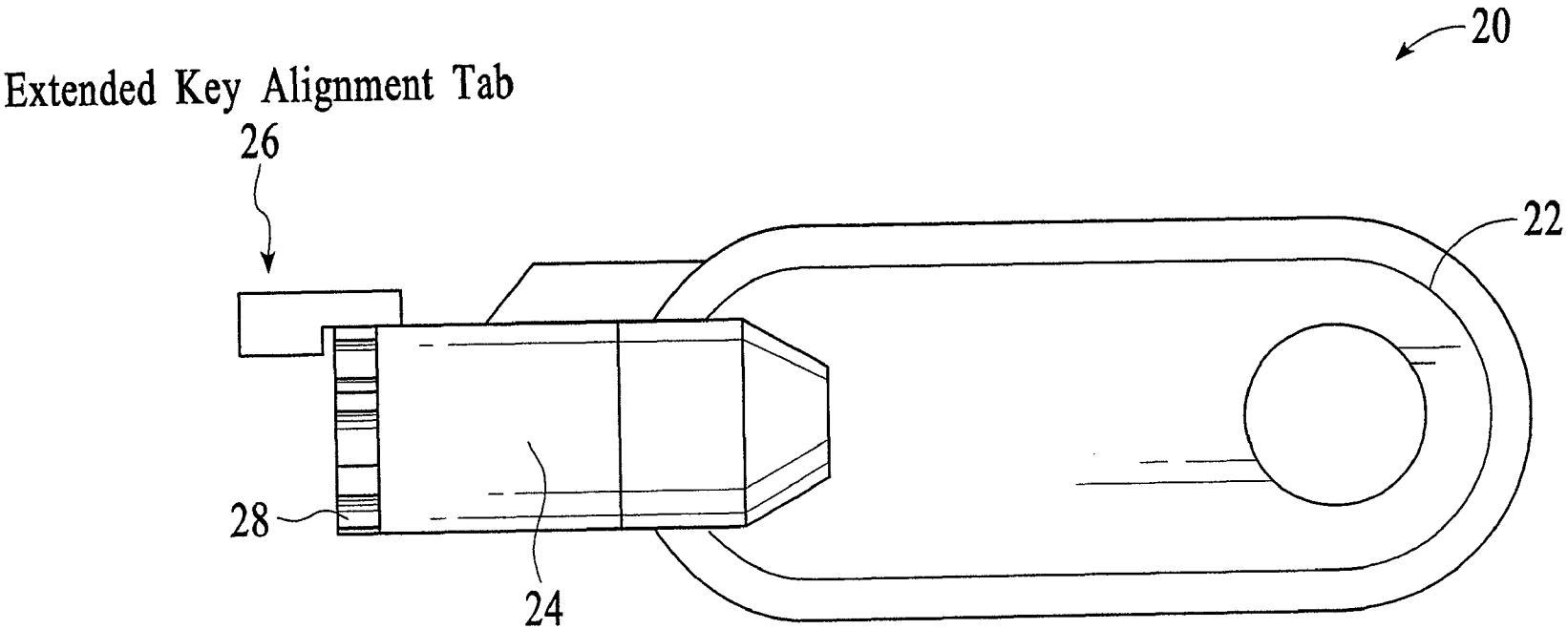
FIG. 2 discloses a side view of a key according to an embodiment of the invention.

FIG. 2 shows a key 20 according to an embodiment of the invention. The key 20 includes a handle 22, a coded portion 24 with notches 28 coupled to the handle 22, and an extended portion 26 extending from the coded portion 24. In this example, the coded portion 24 may be circular in shape.

The extended portion 26 may be an extended key alignment tab. The extended alignment tab can serve two functions. It can serve as an alignment guide for a user, so that the user can align the coded portion 28 of the key 20 with the keyway of the lock device 102. As indicated above, the alignment tab can also serve to fill the passage in the locking spindle down to the shear line in the lock device. This keeps the driver pins from entering the passage 51 in the locking spindle 42.

Figure 3:
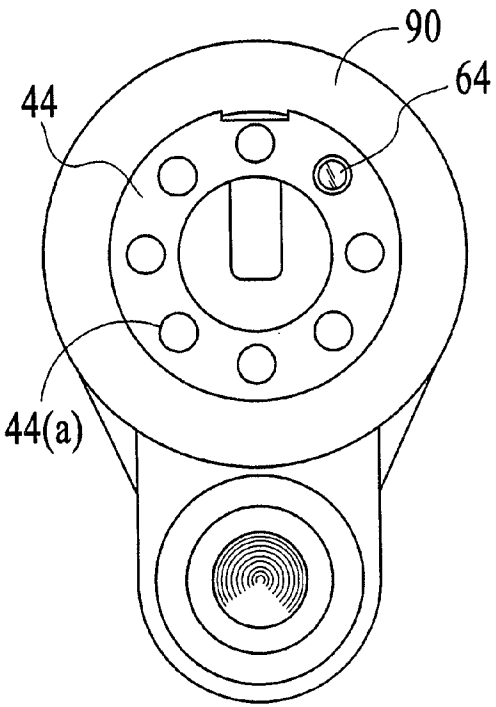
FIG. 3 shows a front, cross-sectional view of a lock device along the line 3-3 in FIG. 1.

FIG. 3 shows a front, cross-sectional view of the lock device along the line 3-3 in FIG. 1. As shown in FIG. 3, a number of driver structure bores 44(*a*) are present in the driver structure 44, which is disposed within the housing 90. In this example, there are six driver structure bores 44(*a*) arranged in a circle. One driver pin 64 is shown in one of the bores 44(*a*) for clarity of illustration. Normally, there would be one driver pin in each of the driver structure bores 44(*a*).

Figure 4:
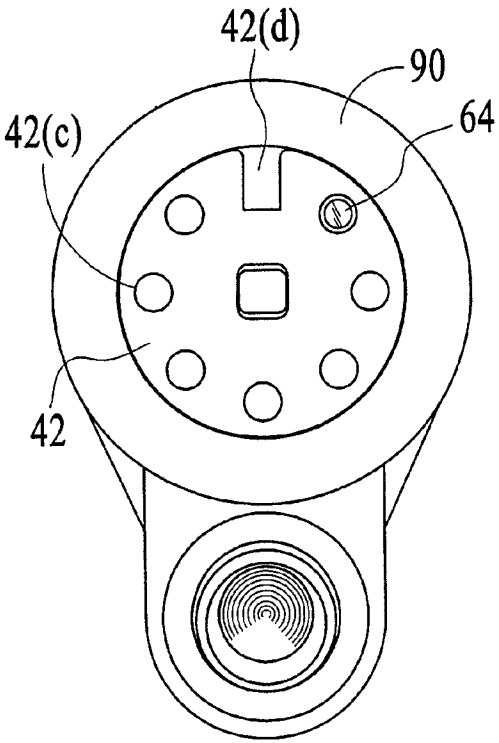
FIG. 4 shows a front, cross-sectional view of a lock device along the line 4-4 in FIG. 1.

FIG. 4 shows a front, cross-sectional view of the lock device along the line 4-4 in FIG. 1. As shown in FIG. 4, a number of locking spindle bores 42(*c*) are in the locking spindle 42. The locking spindle 42 is disposed in the housing 90. An alignment region 42(*d*) in the locking spindle 42 forms part of the previously described passage 51. The alignment region 42(*d*) is in the form of an open channel.

Figure 5:
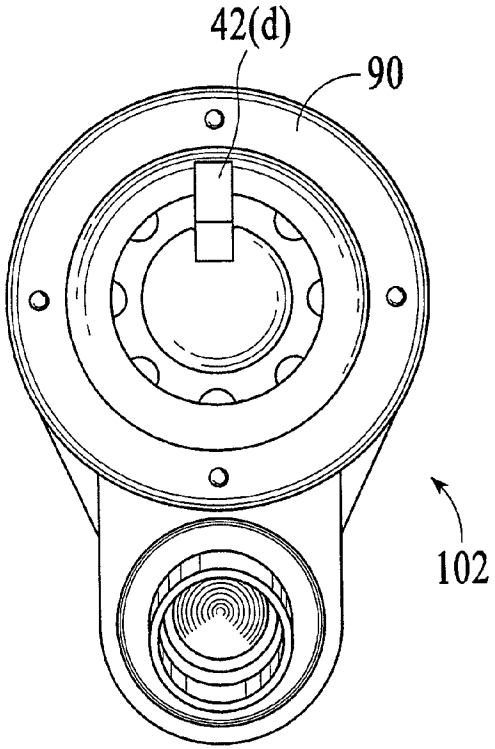
FIG. 5 shows a front view of a lock device according to an embodiment of the invention.

FIG. 5 shows a front view of a lock device 102 according of an embodiment of the invention. In FIG. 5, the alignment region 42(*d*) and the housing 90 are shown. The function of the alignment region and its corresponding passage are not immediately apparent to the end user or unauthorized user.

Figure 6:
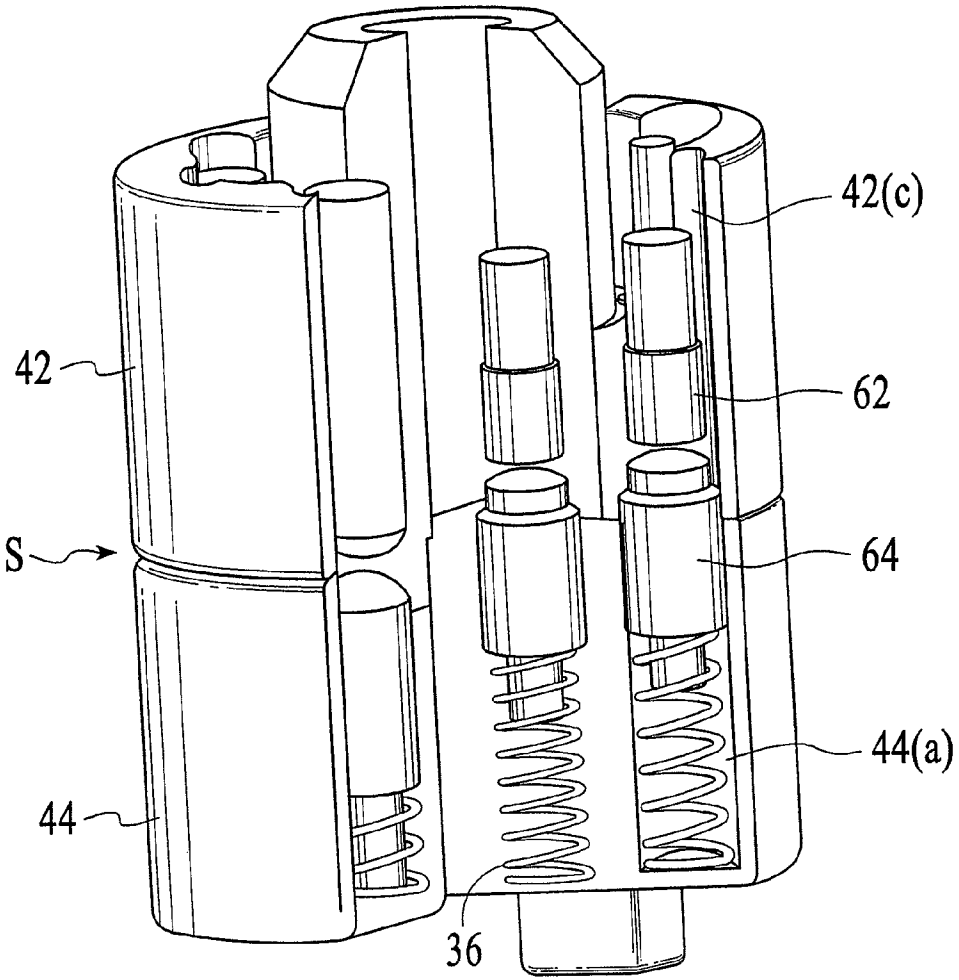
FIG. 6 is a perspective view of a lock device with a portion of the lock device being removed.

FIG. 6 shows a perspective, partial cut away view of a portion of the lock device. In this Figure, the combination pins 62 and driver pins 64 are more clearly illustrated. The combination pins 62 are within locking spindle bores 42(*c*) in the locking spindle 42. The driver pins 64 and corresponding springs 36 are within driver spindle bores 44(*a*) in the driver structure 44. An interface between the locking spindle 42 and the driver structure 44 forms a shear line S. As shown, when the driver pins 64 overlap with the shear line S, the locking spindle 42 cannot fully rotate with respect to the driver structure 44.

Figure 8:
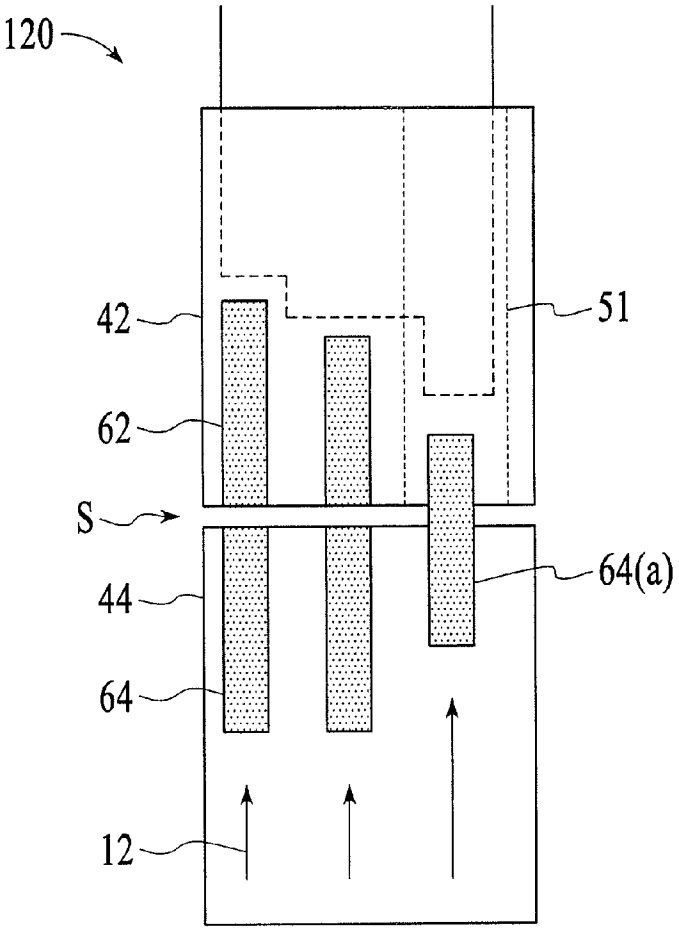
FIG. 8 shows a schematic view showing how the lock device would function if one tries to turn the locking spindle with an unauthorized tubular structure.
Figure 7:
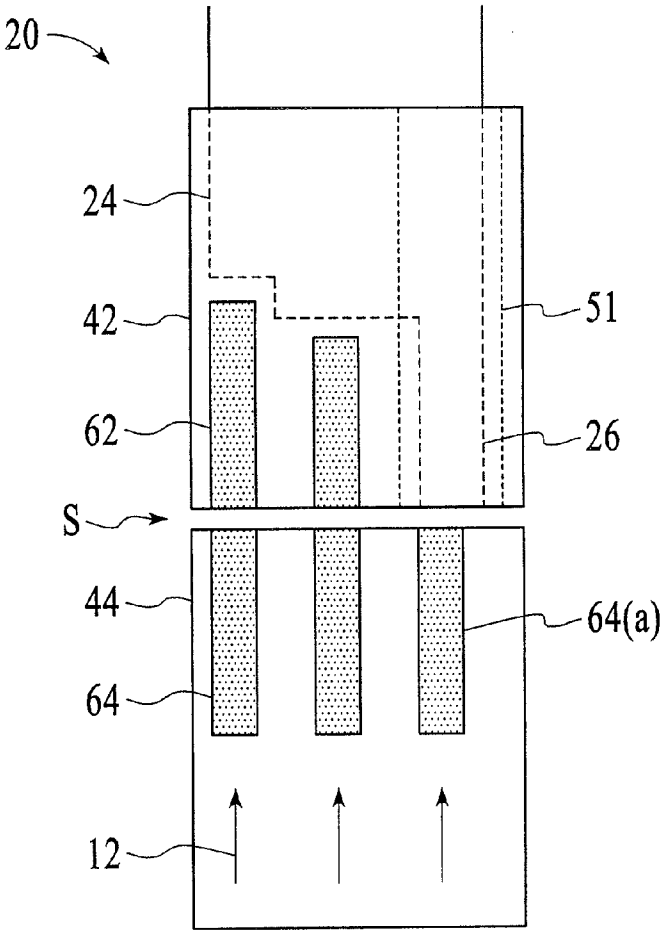
FIG. 7 shows a schematic view showing how a lock assembly according to an embodiment of the invention would work with a key having an extended alignment structure.

FIGS. 7 and 8 show how an authorized key and an unauthorized tubular structure may work in a lock device according to an embodiment of the invention. For clarity of illustration, pins are illustrated but their corresponding bores are not illustrated in these Figures.

FIG. 7 shows a schematic illustration of the how the driver and combination pins are positioned when an authorized key is used in the lock device. In this example, a key 20 is inserted into a keyway in a lock device. The coded portion 24 of the key 20 pushes the left pair of combination pins down, thereby pushing the driver pins 64 down under the shear line S. An extended portion 26 of the key 20 extends to the shear line S and passes through the passage 51. As a result, when the locking spindle 42 rotates with respect to the driver structure 44, each of the driver pins 64 stays below the shear line S.

FIG. 8 shows a schematic illustration of the how the driver and combination pins are positioned when an unauthorized tubular structure 120 is used in the lock device. As shown, when an unauthorized user tries to push the unauthorized tubular structure 120 into the keyway to turn the locking spindle 42, the deformed tubular structure 120 does not have a portion that extends all the way down to the shear line S. Consequently, when the unauthorized user tries to rotate the locking spindle 42, the driver pin 64(*a*) is biased upward into the passage 51, as shown by the arrows 12, and lies across the shear line S. This prevents the locking spindle 42 from rotating further with respect to the driver structure 44.

Figure 9:
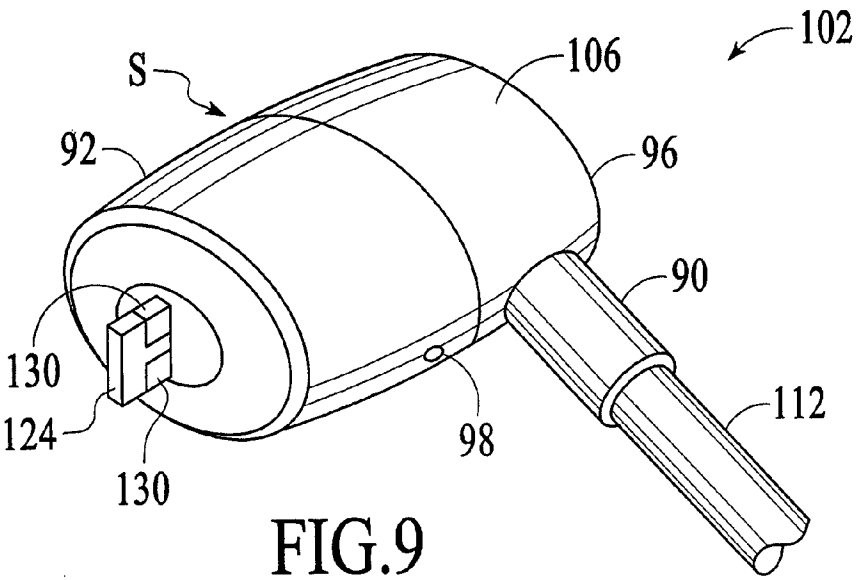
FIG. 9 shows a perspective view of another lock device according to another embodiment of the invention.

FIG. 9 shows a perspective view of a lock device according to another embodiment of the invention. The lock device includes a locking member 124 in the form of a cross-member or T-bar, and a pair of locking pins 130. The locking member 124 may be coupled to the previously described locking spindle so that it can rotate when the locking spindle rotates. As shown, the cross-bar portion of the locking member may be aligned with the pins 130. They may be inserted together into a security slot or the like.

Figure 10:
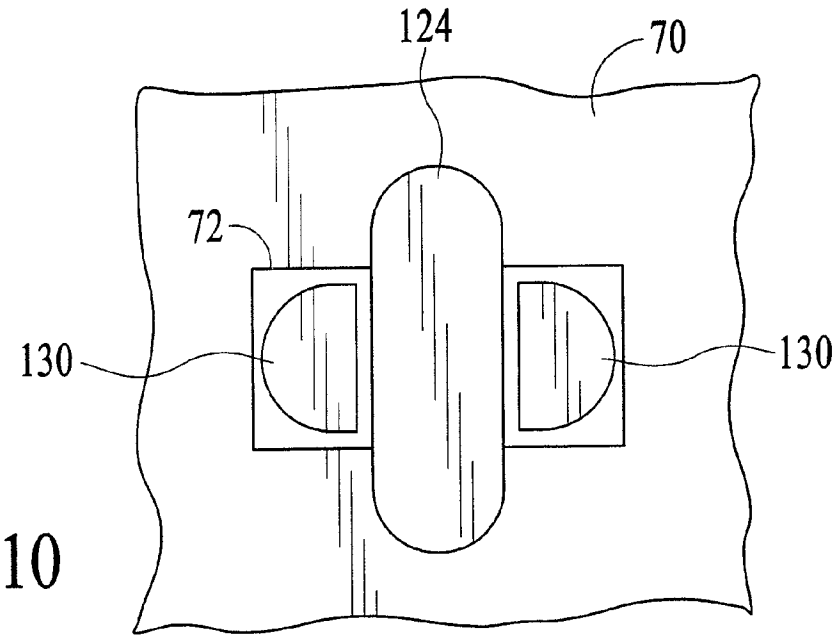
FIG. 10 shows pins and a locking member when they are present within a security slot in a housing of a portable electronic device.

FIG. 10 shows the pins and a locking member of a lock device extending through a security slot 72 in a housing 70 of a portable electronic device. As shown, after the cross-bar portion of the locking member is inserted into the slot with the pins, the locking member is turned so that the cross-bar is oriented perpendicular to the orientation of the slot 72. This secures the lock device to the housing 70. In embodiments of the invention, security slots that are generally rectangular and/or have dimensions of about 3 mm by about 7 mm are preferred. Small security slots do not significantly alter the aesthetic appearance of portable electronic devices, but can be used to deter theft. For example, if a thief tries to separate a lock device from a portable electronic device, the portable electronic device will be damaged, thereby impairing its value.

Other features that can be used in the lock devices according to embodiments of the invention are described in U.S. Pat. Nos. 6,006,557 and 5,502,989, which are herein incorporated by reference in their entirety for all purposes.

Embodiments of the invention provide for a number of advantages. For example, the presence of the elongated passage in the previously described locking spindle is not readily apparent to an unauthorized user. Thus, when the unauthorized user tries to pick the lock, the unauthorized user will not understand why the lock cannot be picked. In addition, embodiments of the invention are relatively easy to incorporate into a cylindrical lock and no elaborate modifications are needed.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents. Also, any one or more features of one embodiment may be combined with any one or more features of any other embodiment without departing from the spirit and the scope of the invention.

Any reference to positions such as "rear", "forward", "top", "bottom", "upper", "lower", etc. refer to the Figures and are used for convenience. They are not intended to refer to absolute positions.

A recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A lock device for use with a key with an extended portion, the lock device comprising:

a locking spindle including a passage extending axially along an axial length of the locking spindle;

a driver structure, wherein an interface between the driver structure and the locking spindle forms a shear line, further wherein the locking spindle includes a plurality of locking spindle bores and the driver structure includes a plurality of driver structure bores; and a locking member coupled to a distal end of the locking spindle, wherein the passage extends to the shear line and the extended portion of the key fills the passage to the shear line when the key is used to turn the locking spindle.

2. The lock device of claim 1 further comprising a plurality of combination pins in the plurality of locking spindle bores; and a plurality of driver pins in the driver structure bores in the driver structure, the plurality of driver pins being respectively associated with the plurality of combination pins.

3. The lock device of claim 1 wherein the lock device is a cylinder lock.

4. A lock device for use with a key with an extended portion, the lock device comprising:

a locking spindle including a passage extending axially along an axial length of the locking spindle;

a driver structure, wherein an interface between the driver structure and the locking spindle forms a shear line; and a locking member coupled to a distal end of the locking spindle, wherein the passage extends to the shear line and the extended portion of the key fills the passage to the shear line when the key is used to turn the locking spindle, further wherein the locking member is in the form of a T-bar.

5. The lock apparatus of claim 2 wherein the extended portion is configured to keep a driver pin from entering the passage when the key is used to turn the locking spindle.

6. The lock device of claim 1 wherein the passage coincides with an alignment tab region of the lock device.

7. The lock device of claim 1 further comprising a plurality of springs in the driver structure bores in the driver structure.

8. A locking apparatus comprising:

the lock device of claim 1; and a key comprising a handle, an extended portion, and a coded portion between the handle and the extended portion, wherein the extended portion extends to the shear line when the key is used to lock or unlock the lock device.

9. A locking apparatus comprising:

a lock device for use with a key with an extended portion, the lock device comprising a locking spindle including a passage extending axially along an axial length of the locking spindle, a driver structure, wherein an interface between the driver structure and the locking spindle forms a shear line, and a locking member coupled to a distal end of the locking spindle, wherein the passage extends to the shear line and the extended portion of the key fills the passage to the shear line when the key is used to turn the locking spindle; and a key comprising a handle, an extended portion, and a coded portion between the handle and the extended portion, wherein the extended portion extends to the shear line when the key is used to lock or unlock the lock device, further wherein the coded portion is circular.

10. The locking apparatus of claim 8 wherein the lock device further comprises a housing disposed around the locking spindle and the driver structure, and a pair of parallel pins coupled to the housing.

11. A security system comprising a locking apparatus comprising a lock device for use with a key with an extended portion, the lock device comprising a locking spindle including a passage extending axially along an axial length of the locking spindle, a driver structure, wherein an interface between the driver structure and the locking spindle forms a shear line, and a locking member coupled to a distal end of the locking spindle, wherein the passage extends to the shear line and the extended portion of the key fills the passage to the shear line when the key is used to turn the locking spindle, and a key comprising a handle, an extended portion, and a coded portion between the handle and the extended portion, wherein the extended portion extends to the shear line when the key is used to lock or unlock the lock device; and a portable electronic device, wherein the locking apparatus is used to secure the portable electronic device to an object other than the locking apparatus.

12. A locking apparatus comprising:

a lock device comprising a locking spindle including a passage extending axially along an axial length of the locking spindle, a locking member coupled to a distal end of the locking spindle, a driver structure, wherein an interface between the driver structure and the locking spindle forms a shear line and the passage extends through the locking spindle to the shear line, wherein the locking spindle includes a plurality of locking spindle bores, the driver structure includes a plurality of driver structure bores, the locking apparatus further comprising a plurality of combination pins in the plurality of locking spindle bores, and a plurality of driver pins in the driver structure bores in the driver structure, the plurality of driver pins being respectively associated with the plurality of combination pins; and a key including a coded portion and an extended portion, wherein the extended portion is configured to fit in the passage and serves to temporarily provide a solid surface for the locking spindle at the shear line while the key is inserted into the lock device.

* * * * *